US009108401B2

(12) United States Patent
Hayakawa et al.

(10) Patent No.: US 9,108,401 B2
(45) Date of Patent: Aug. 18, 2015

(54) IMAGE RECORDING APPARATUS WITH RECORDING DENSITY AND EJECTION TIMING CORRECTION

(75) Inventors: Masahiro Hayakawa, Kyoto (JP); Keiji Hatano, Kyoto (JP)

(73) Assignee: SCREEN HOLDINGS CO., LTD., Kyoto (JP)

( * ) Notice: Subject to any disclaimer, the term of this patent is extended or adjusted under 35 U.S.C. 154(b) by 0 days.

(21) Appl. No.: 14/235,786

(22) PCT Filed: Jul. 25, 2012

(86) PCT No.: PCT/JP2012/068865

§ 371 (c)(1),
(2), (4) Date: Jan. 28, 2014

(87) PCT Pub. No.: WO2013/018622

PCT Pub. Date: Feb. 7, 2013

(65) Prior Publication Data

US 2014/0152732 A1 Jun. 5, 2014

(30) Foreign Application Priority Data

Jul. 29, 2011 (JP) ..... 2011-166912

(51) Int. Cl.

| | |
|---|---|
| ***B41J 2/205*** | (2006.01) |
| ***B41J 2/045*** | (2006.01) |
| ***B41J 2/005*** | (2006.01) |
| ***B41J 29/38*** | (2006.01) |

(52) U.S. Cl.

CPC ..... *B41J 2/04508* (2013.01); *B41J 2/0057* (2013.01); *B41J 29/38* (2013.01)

(58) Field of Classification Search

CPC ..... B41J 2/0057; B41J 29/38; B41J 2/04508
USPC ..... 347/15
See application file for complete search history.

(56) References Cited

U.S. PATENT DOCUMENTS

| | | | |
|---|---|---|---|
| 2007/0296752 | A1 | 12/2007 | Maruo et al. |
| 2009/0051717 | A1 | 2/2009 | Kuwahara |
| 2010/0060691 | A1 | 3/2010 | Tanase et al. |

FOREIGN PATENT DOCUMENTS

| | | | |
|---|---|---|---|
| JP | 2007-021834 | A | 2/2007 |
| JP | 2008-001053 | A | 1/2008 |

(Continued)

OTHER PUBLICATIONS

International Search Report issued in International Application No. PCT/JP2012/068865 mailed Oct. 23, 2012, with English translation, 4 pgs. X.

(Continued)

*Primary Examiner* — Julian Huffman
*Assistant Examiner* — Carlos A Martinez
(74) *Attorney, Agent, or Firm* — McDermott Will & Emery LLP

(57) ABSTRACT

An image recording apparatus includes a head for ejecting ink, a moving mechanism for moving a recording medium, and a control part for controlling these constituent elements. The control part includes an information storage part, a conversion part, and a correction part. The conversion part converts input image data into converted image data which is suitable for image recording. The information storage part stores an LUT indicating a relation between the input image data and the converted image data for each head and each type of recording medium. The correction part updates the LUT on a representative recording medium on the basis of correction amounts determined in accordance with reference images which are recorded onto the representative recording medium and further updates the LUT on another type of recording medium. By virtue of providing this correction part, it is possible to simplify a correcting operation of recording densities.

16 Claims, 11 Drawing Sheets

(56) References Cited

FOREIGN PATENT DOCUMENTS

| | | | |
|---|---|---|---|
| JP | 2009-051066 | A | 3/2009 |
| JP | 2010-089488 | A | 4/2010 |
| JP | 2010-136060 | A | 6/2010 |

OTHER PUBLICATIONS

Notification Concerning transmittal of Copy of International Preliminary Report on Patentability Issued in International Application No. PCT/JP20121068865 dated Feb. 13, 2014, w/English translation. X.

IMAGE RECORDING APPARATUS WITH RECORDING DENSITY AND EJECTION TIMING CORRECTION

RELATED APPLICATIONS

This application is the U.S. National Phase under 35 U.S.C. §371 of International Application No. PCT/JP2012/068865, filed on Jul. 25, 2012, which in turn claims the benefit of Japanese Application No. 2011-166912, filed on Jul. 29, 2011, the disclosures of which are incorporated by reference herein.

TECHNICAL FIELD

The present invention relates to a technique for recording an image onto a recording medium.

BACKGROUND ART

Conventionally, some of image recording apparatuses such as inkjet printers or the like have a function of correcting a displacement of recording position. For example, a recording system disclosed in Japanese Patent Application Laid Open Gazette No. 2008-1053 includes a transfer device for transferring a plurality of recording units and recording media, and each of the recording units has a plurality of recording heads for ejecting inks of respective colors of CMYK. For adjusting a recording displacement between recording heads in a longitudinal direction along a direction of transfer, a plurality of horizontal bars extending in a lateral direction orthogonal to the direction of transfer are recorded in the longitudinal direction by a reference head. At the same time, a comparison head records a plurality of horizontal bars adjacent to the above horizontal bars while shifting recording timing by a unit amount. By checking a position at which the horizontal bar recorded by the reference head and the horizontal bar recorded by the comparison head coincide with each other in the longitudinal direction, the recording timing of the comparison head is adjusted.

For adjusting a recording displacement between recording heads in the lateral direction, a plurality of vertical bars arranged in the lateral direction are recorded by the reference head. The comparison head records a plurality of vertical bars below the above vertical bars while shifting recording timing by a unit amount. By checking a position at which the vertical bar recorded by the reference head and the vertical bar recorded by the comparison head coincide with each other in the lateral direction, the recording timing of the comparison head is adjusted.

Incidentally, in a case of using a so-called one-pass inkjet printer which records an image by one pass of a recording medium below a head, it is necessary to correct a difference in the density of image and a difference in the ejection timing between heads with high precision.

Therefore, in such an image recording apparatus, when some of heads are changed due to a failure of the head or the like, it is necessary to correct recording densities and ejection timing of the changed head every time when an image is recorded onto a recording medium having different surface property or thickness. As a result, a correction operation becomes complicated.

SUMMARY OF INVENTION

The present invention is intended for an image recording apparatus for recording an image onto a recording medium, and it is an object of the present invention to simplify a correcting operation of recording densities and a correcting operation of ejection timing information regarding a changed head.

The image recording apparatus according to one aspect of the present invention includes a plurality of heads arranged in a width direction of a recording medium or arranged in a direction crossing a direction perpendicular to the width direction, for ejecting droplets of ink, a moving mechanism for moving the recording medium relatively with respect to the plurality of heads in the direction perpendicular to the width direction, and a control part for controlling the plurality of heads and the moving mechanism to record an image onto the recording medium by one relative movement of the recording medium with respect to the plurality of heads. Each of the plurality of heads is individually changeable to a new head.

The control part includes a storage part for storing a plurality of pieces of conversion information corresponding to types of recording media onto which images are recorded, each piece of conversion information indicating a relation between input pixel values which are pixel values indicated by input image data and values used for generation of signals to be inputted, correspondingly to the input pixel values, to each of the plurality of heads, a conversion part for converting pixel values of input image data by using conversion information associated with each of the plurality of heads, a reference image recording control part for recording a plurality of reference images corresponding to a plurality of input pixel values, respectively, onto a representative recording medium by at least one changed head, a changed head information receiving part for receiving changed head information indicating the changed head among the plurality of heads, and a conversion information updating part to which correction amounts on conversion information corresponding to the changed head are inputted, the correction amounts being determined in accordance with the plurality of reference images which are recorded, the conversion information updating part updating a plurality of pieces of conversion information on the representative recording medium and another type of recording medium, corresponding to the changed head, on the basis of the changed head information and the correction amounts. By the present invention, it is possible to simplify a correcting operation of recording densities of the changed head.

Preferably, the image recording apparatus further includes a scanner for capturing the plurality of reference images which are recorded, to acquire captured data. The control part further includes a correction-amount acquisition part for acquiring a plurality of recording densities from the captured data in accordance with the changed head information, the plurality of recording densities corresponding to the plurality of input pixel values regarding the changed head, obtaining the correction amounts of the conversion information corresponding to the changed head on the basis of the plurality of recording densities, and inputting the correction amounts to the conversion information updating part. It is thereby possible to further simplify the correcting operation of recording densities.

The image recording apparatus according to another aspect of the present invention includes a plurality of heads arranged in a width direction of a recording medium or arranged in a direction crossing a direction perpendicular to the width direction, for ejecting droplets of ink, a moving mechanism for moving the recording medium relatively with respect to the plurality of heads in the direction perpendicular to the width direction, and a control part for controlling the plurality of heads and the moving mechanism to record an image onto the recording medium by one relative movement of the recording medium with respect to the plurality of heads. Each of the plurality of heads is individually changeable to a new head.

The control part includes a storage part for storing a plurality of pieces of ejection timing information corresponding to types of recording media onto which images are recorded, each piece of ejection timing information indicating an ejection timing of each of the plurality of heads, a reference image recording control part for recording a reference image onto a representative recording medium by two or more heads including at least one changed head and an unchanged head, a changed head information receiving part for receiving changed head information indicating the changed head among the plurality of heads, and an information updating part to which a correction amount on ejection timing information corresponding to the changed head is inputted, the correction amount being determined in accordance with the reference image which is recorded, the information updating part updating a plurality of pieces of ejection timing information on the representative recording medium and another type of recording medium, corresponding to the changed head, on the basis of the changed head information and the correction amount. By the present invention, it is possible to simplify a correcting operation of ejection timing information of the changed head.

Preferably, the image recording apparatus further includes a scanner for capturing the reference image which is recorded, to acquire captured data. The control part further includes a correction-amount acquisition part for acquiring a recording displacement amount between the two or more heads from the captured data in accordance with the changed head information, obtaining the correction amount of the ejection timing information corresponding to the changed head on the basis of the recording displacement amount, and inputting the correction amount to the information updating part. It is thereby possible to further simplify the correcting operation of ejection timing information.

The present invention is also intended for a recording density correction method of correcting recording densities of a changed head in an image recording apparatus. The image recording apparatus includes a plurality of heads arranged in a width direction of a recording medium or arranged in a direction crossing a direction perpendicular to the width direction, for ejecting droplets of ink, a moving mechanism for moving the recording medium relatively with respect to the plurality of heads in the direction perpendicular to the width direction, and a control part for controlling the plurality of heads and the moving mechanism to record an image onto the recording medium by one relative movement of the recording medium with respect to the plurality of heads. The control part includes a storage part for storing a plurality of pieces of conversion information corresponding to types of recording media onto which images are recorded, each piece of conversion information indicating a relation between input pixel values which are pixel values indicated by input image data and values used for generation of signals to be inputted, correspondingly to the input pixel values, to each of the plurality of heads. Each of the plurality of heads is individually changeable to a new head.

The recording density correction method includes a) a step of recording a plurality of reference images corresponding to a plurality of input pixel values, respectively, onto a representative recording medium by the changed head which is at least one head, b) a step of determining correction amounts of conversion information corresponding to the changed head in accordance with the plurality of reference images which are recorded, and c) a step of updating a plurality of pieces of conversion information on the representative recording medium and another type of recording medium, corresponding to the changed head, on the basis of the correction amounts. By the present invention, it is possible to simplify a correcting operation of recording densities of the changed head.

The present invention is still also intended for an ejection timing correction method of correcting an ejection timing of a changed head in an image recording apparatus. The image recording apparatus has the same constitution as that in the recording density correction method, except the control part. The control part includes a storage part for storing a plurality of pieces of ejection timing information corresponding to types of recording media onto which images are recorded, each piece of ejection timing information indicating an ejection timing of each of the plurality of heads.

The ejection timing correction method includes a) a step of recording a reference image onto a representative recording medium by two or more heads including at least one changed head and an unchanged head, b) a step of determining a correction amount on ejection timing information corresponding to the changed head in accordance with the reference image which is recorded, and c) a step of updating a plurality of pieces of ejection timing information on the representative recording medium and another type of recording medium, corresponding to the changed head, on the basis of the correction amount. By the present invention, it is possible to simplify a correcting operation of ejection timing information of the changed head.

These and other objects, features, aspects and advantages of the present invention will become more apparent from the following detailed description of the present invention when taken in conjunction with the accompanying drawings.

DESCRIPTION OF EMBODIMENTS

Figure 1:
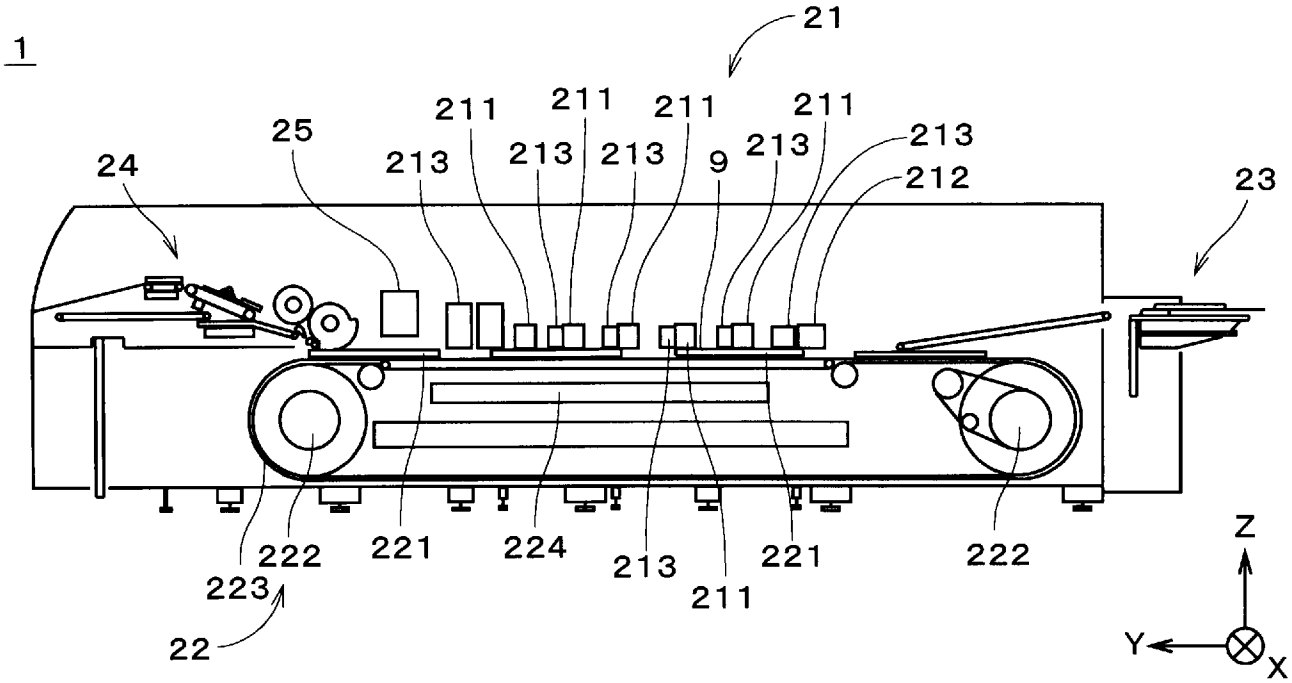
FIG. 1 is a view showing an image recording apparatus.

FIG. 1 is a view showing a configuration of an inkjet type image recording apparatus 1 in accordance with a preferred embodiment of the present invention. The image recording apparatus 1 is a color printer for recording color images onto a recording medium 9. In the present preferred embodiment, as the recording medium 9, used is recording paper such as coated paper, wood free paper, or the like. The image recording apparatus 1 is a sheet-fed apparatus which sequentially records images onto a plurality of recording media 9.

The image recording apparatus 1 includes a recording unit 21 for ejecting inks of CMYK, a moving mechanism 22, a feeding part 23, a collecting part 24, a scanner 25, and a control part for controlling these constituent elements. The recording unit 21 ejects droplets of ink toward the recording medium 9. The moving mechanism 22 relatively moves the recording medium 9 with respect to the recording unit 21 in the (+Y) direction of FIG. 1. The feeding part 23 holds a plurality of recording media 9 and sequentially feeds the plurality of recording media 9 into the moving mechanism 22. The collecting part 24 collects the recording medium 9 onto which an image is recorded. The scanner 25 is disposed on the (+Y) side of the recording unit 21.

In the image recording apparatus 1, in synchronization with a relative movement of the recording medium 9 in the (+Y) direction, ejection of ink from the recording unit 21 is controlled by the control part, and an image is thereby recorded onto the recording medium 9. In FIG. 1, the X direction, the Y direction, and the Z direction are perpendicular to one another, and the Z direction corresponds to a vertical direction. In the following discussion, the (+Y) direction will be referred to as a "moving direction". The recording medium 9 is transferred in a posture parallel to the X direction and the Y direction.

The moving mechanism 22 includes two belt rollers 222, a belt 223 hung on the two belt rollers 222, a plurality of tables 221, and a linear motor mechanism 224. The belt rollers 222 are arranged along the moving direction of the recording medium 9 and connected to a not shown motor. The plurality of tables 221 are attached onto the belt 223. In the moving mechanism 22, with counterclockwise rotation of the belt roller 222, the tables 221 are moved along a circled track at high speed. In order to record an image, the table 221 holding one recording medium 9 is removed from the belt 223 and moved in the moving direction with high precision by the linear motor mechanism 224. Then, after image recording is finished, the table 221 is attached to the belt 223 again.

The recording unit 21 includes a preprocessing part 212, a plurality of recording parts 211 for ejecting inks of CMYK, and a plurality of heaters 213. The preprocessing part 212 applies a transparent preprocessing agent to the recording medium 9 before an image is recorded thereonto as necessary. The heater 213 blows hot air on the recording medium 9, to thereby dry the ink on the recording medium 9.

Figure 2:
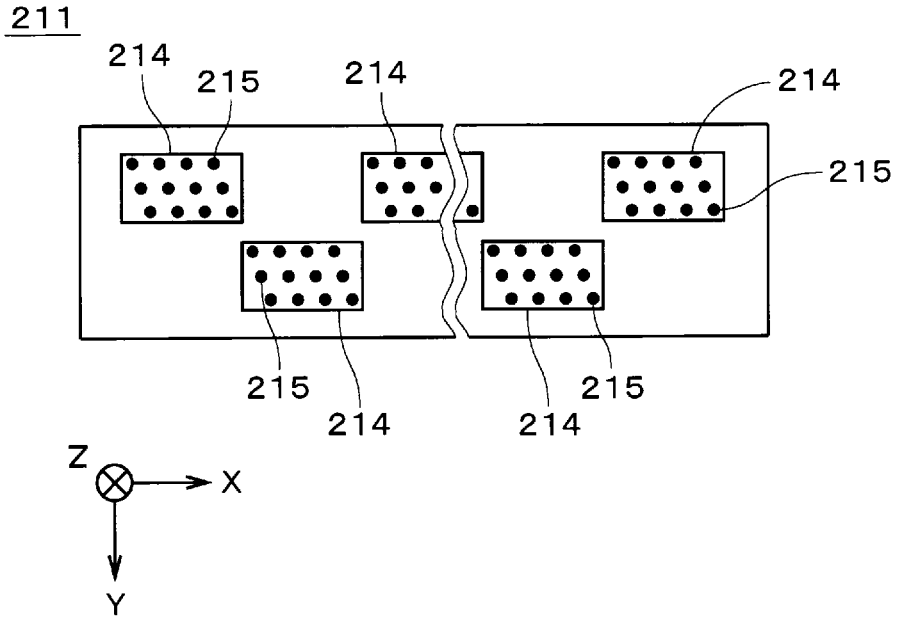
FIG. 2 is a bottom view of heads.

FIG. 2 is a bottom view of the recording part 211. In the recording part 211, a plurality of heads 214 are arranged in a staggered manner in a width direction of the recording medium 9, i.e., in the X direction which is a direction perpendicular to the moving direction and parallel to a recording surface of the recording medium 9. Hereinafter, the X direction will be referred to as an "arrangement direction". Each of the plurality of heads 214 is individually changeable to a new head. At a bottom surface of each of the heads 214, provided are a plurality of discharge ports 215 each for ejecting droplets of ink toward the recording medium 9 (in the (−Z) direction of FIG. 1). In FIG. 2, however, the arrangement of the discharge ports 215 is simply shown, and actually a lot of (e.g., 720) discharge ports are arranged (in one head 214). A resolution of an image recorded by the image recording apparatus is, for example, 720 dpi. In the head 214, ejection of droplets from the discharge ports 215 is achieved by piezoelectric elements, but a head which ejects droplets by other methods may be adopted.

The preprocessing part 212 and the recording parts 211 shown in FIG. 1 are provided over an entire printing area on the recording medium 9 in the arrangement direction, and with one relative movement of the recording medium 9 by the moving mechanism 22 with respect to the heads 214 (in other words, by moving the recording medium 9 in the moving direction to pass below the heads 214 just once), recording of a halftone dot image is completed (so-called one pass printing is performed).

Figure 3:
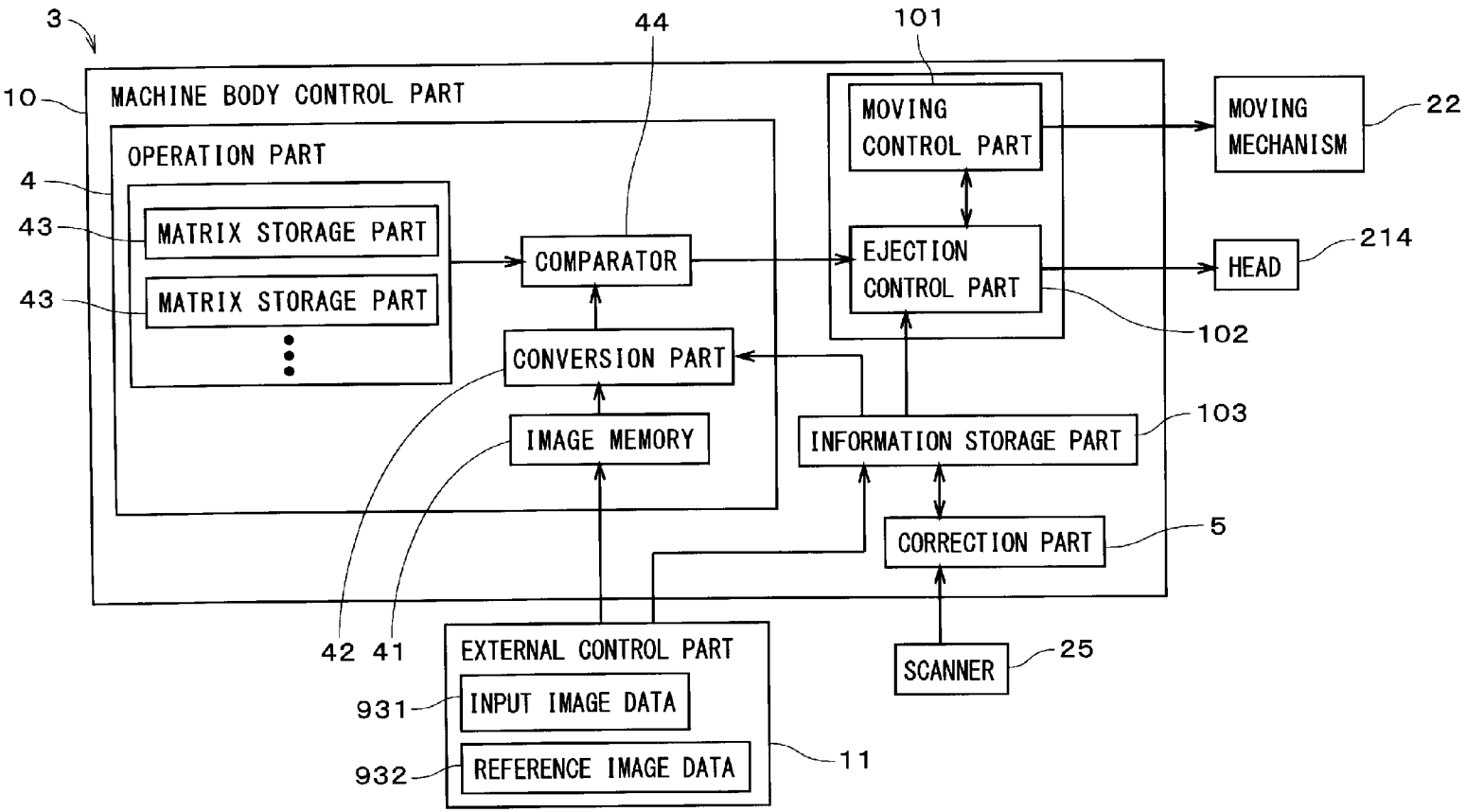
FIG. 3 is a view showing a functional constitution of a control part.

FIG. 3 is a block diagram showing a functional constitution of the image recording apparatus 1. The control part 3 includes a machine body control part 10 and an external control part 11. The external control part 11 is an ordinary computer and may be provided inside the apparatus body. The machine body control part 10 includes a moving control part 101, an ejection control part 102, a calculation part 4, an information storage part 103, and a correction part 5.

The moving control part 101 controls the relative movement of the recording medium 9 by the moving mechanism 22 with respect to the heads 214. The ejection control part 102 controls the ejection of ink from the heads 214 in synchronization with the relative movement of the recording medium 9. The calculation part 4 includes an image memory 41, a conversion part 42, a plurality of matrix storage parts 43, and a comparator 44 (halftoning circuit). The image memory 41 stores data 931 (hereinafter, referred to as "input image data") of an input image inputted from the external control part 11. The conversion part 42 converts pixel values of the input image data 931 into pixel values suitable for image recording. Hereinafter, the image data constituted of the converted pixel values will be referred to as "converted image data".

The matrix storage parts 43 store threshold matrices for a plurality of color components, respectively. The threshold matrix is an two-dimensional array of a plurality of threshold values. The matrix storage part 43 is also referred to as an SPM (Screen Pattern Memory). The comparator 44 compares the converted image data and the threshold matrix for each color component, to thereby generate binary halftone dot image data for controlling ejection of ink from each of the heads 214. The conversion part 42 and the comparator 44 may be implemented by software. The halftone dot image data is transmitted to the ejection control part 102, and the ejection control part 102 sends signals for controlling ejection of ink, to each of the heads 214.

The information storage part 103 stores therein a look-up table (hereinafter, referred to as an "LUT") which is conversion information indicating a relation of the pixel values of the input image data 931 and the pixel values of the converted image data for each head 214 and each type of recording medium and ejection timing information indicating an ejection timing of ink from each of the heads 214. Herein, the type of recording medium refers to a type including surface property of recording medium and a thickness of recording medium.

Figure 4:
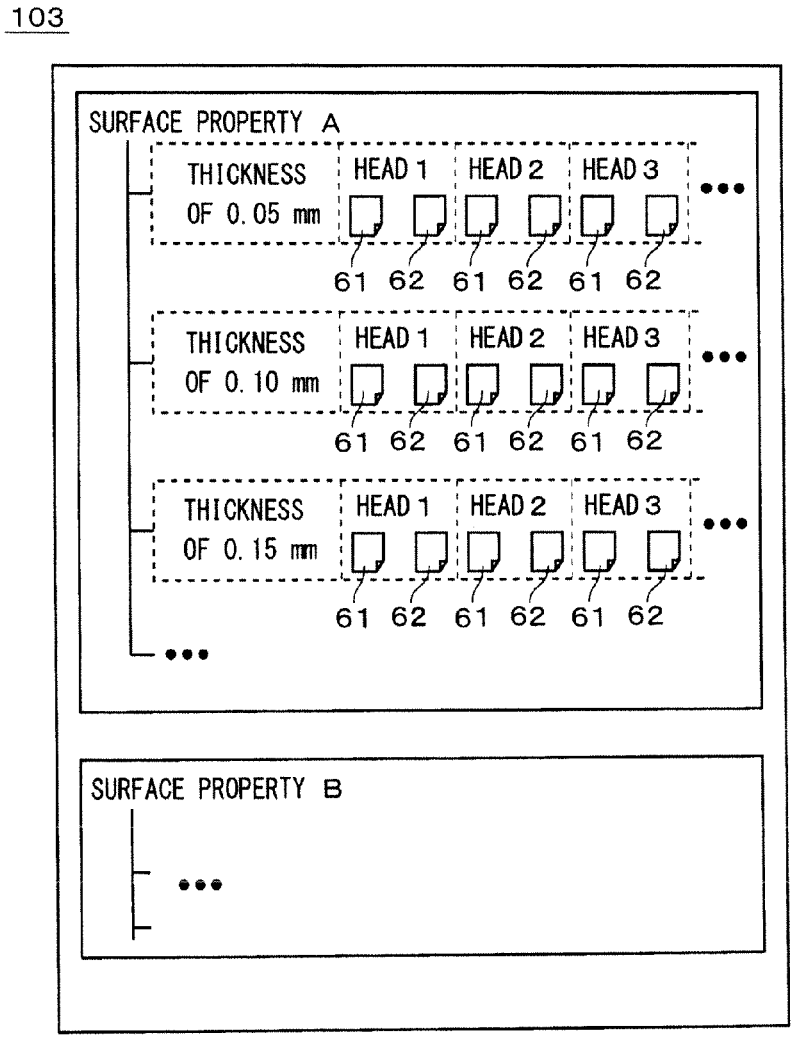
FIG. 4 is a view showing an information storage part.

FIG. 4 is a view showing LUTs 61 and pieces of ejection timing information 62 stored in the information storage part 103. The LUTs 61 and the pieces of ejection timing information 62 are divided into a plurality of groups in accordance with the type of recording medium in the information storage part 103. In the present preferred embodiment, the LUTs 61 and the pieces of ejection timing information 62 are first grouped by recording media having different surface properties, and each group is further divided into small groups by the thickness of recording medium. Each small group includes head numbers corresponding to the heads 214 and the LUT 61 and the ejection timing information 62 for each head number.

Figure 5:
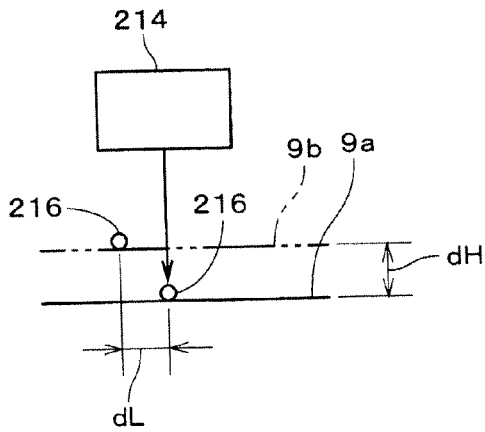
FIG. 5 is a view showing the head and recording media.

Herein, discussion will be made on a difference of ejection timing between the recording media having different thicknesses. FIG. 5 is a view showing the head 214 and two types of recording media 9*a* and 9*b* having different thicknesses. The surface level of the recording medium 9*a* is indicated by the solid line and the surface level of the recording medium 9*b* is indicated by the two-dot chain line. In FIG. 5, the difference dH in the surface level between the recording media 9*a* and 9*b* is exaggeratingly shown. If the two recording media 9*a* and 9*b* pass below the head 214 at the same movement speed at the same time, a droplet 216 of ink is landed onto the recording medium 9*b* whose surface level is higher earlier than the recording medium 9*a* whose surface level is lower. As a result, there arises a recording displacement of image by a distance dL in the moving direction. Therefore, in the image recording apparatus 1, different ejection timing information is set for a recording medium having a different thickness with respect to each of the heads 214.

Figure 6:
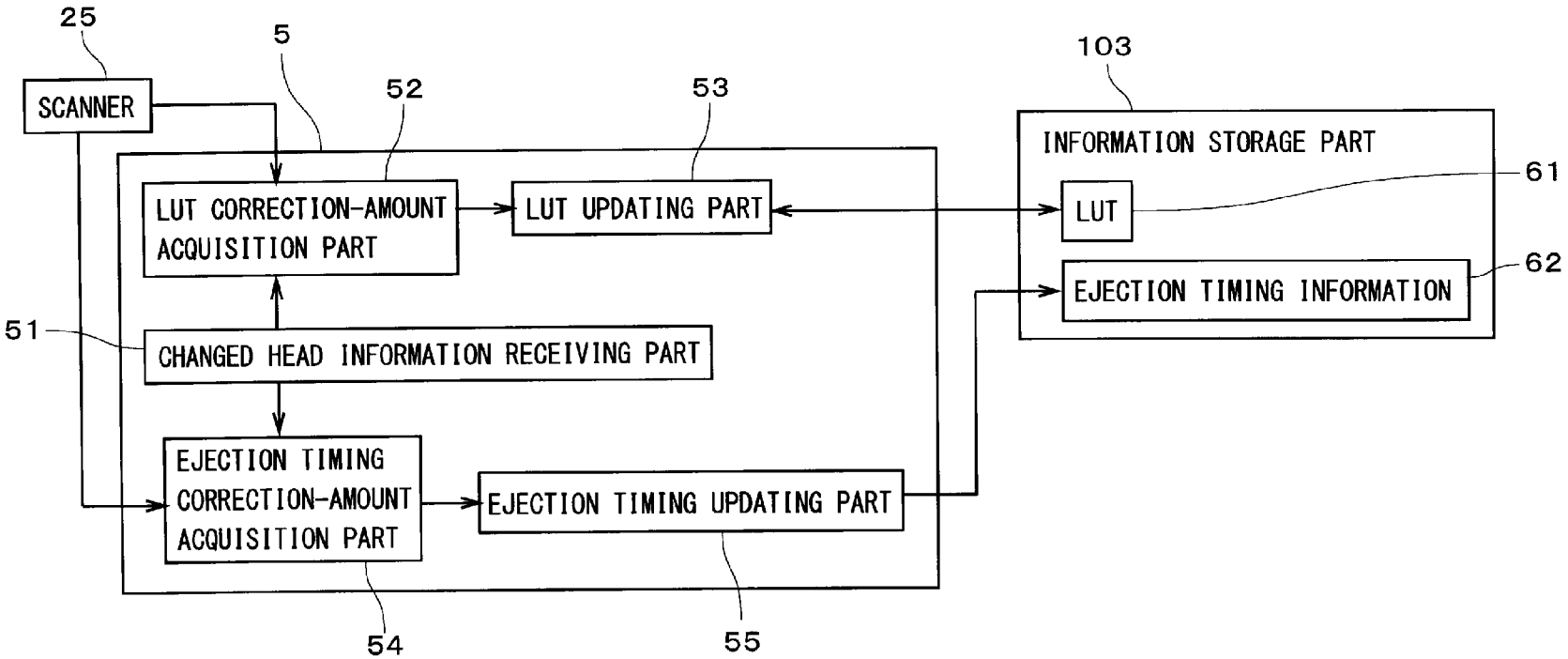
FIG. 6 is a view showing a functional constitution of a correction part.

FIG. 6 is a block diagram showing a functional constitution of the correction part 5. The correction part 5 includes a changed head information receiving part 51, an LUT correction-amount acquisition part 52, an LUT updating part 53, an ejection timing correction-amount acquisition part 54, and an ejection timing updating part 55. When any one head 214 is changed, the changed head information receiving part 51 receives information indicating the head number of a head 214 which is newly attached to the recording part 211 through a GUI (Graphical User Interface) or the like from a user. Hereinafter, the head 214 which has been changed will be referred to as a "changed head 214*a*". A head number indicating the changed head 214*a* will be referred to as a "changed head number". Information indicating the changed head number will be referred to as "changed head information".

The LUT correction-amount acquisition part 52 obtains a correction amount to be used for updating the LUT 61 assigned to the changed head number on the basis of captured data of a reference image described later which is captured by the scanner 25. The LUT updating part 53 is a conversion information updating part for updating the LUT 61 which is conversion information on the basis of the correction amount. The ejection timing correction-amount acquisition part 54 acquires a correction amount regarding update of the ejection timing information 62 assigned to the changed head number on the basis of captured data of another reference image which is captured by the scanner 25. The ejection timing updating part 55 is an information updating part for updating the ejection timing information 62 on the basis of the correction amount. A detailed operation of the correction part 5 will be discussed later.

Figure 7:
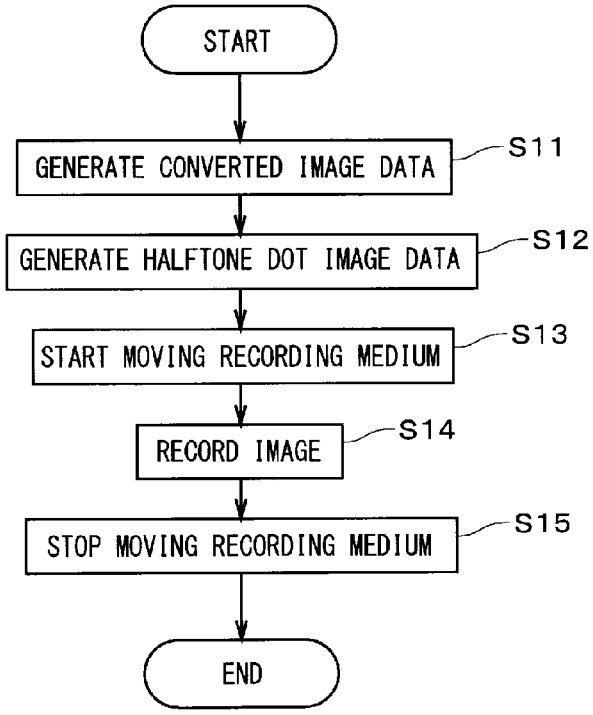
FIG. 7 is a flowchart showing an operation flow for recording an image.

Next, discussion will be made, with reference to FIG. 7, on an operation of the image recording apparatus 1 for recording an image. Though Steps S11, S12, and S14 in FIG. 7 are actually executed for part of the image data or for each pixel, simplified discussion will be made as appropriate. In the image recording apparatus 1, color input image data 931, i.e., image data in which each pixel has gradation values of a plurality of color components, is inputted from the external control part 11 to the image memory 41 of the calculation part 4 shown in FIG. 3 and stored therein.

The input image data 931 is transmitted form the image memory 41 to the conversion part 42. On the other hand, information indicating the type of recording medium, i.e., the surface property and thickness of the recording medium 9, is inputted to the information storage part 103 by a user. The information storage part 103 inputs the LUT of each head 214 regarding the recording medium 9 to the conversion part 42 and inputs the ejection timing information of each head 214 to the ejection control part 102.

Figure 8:
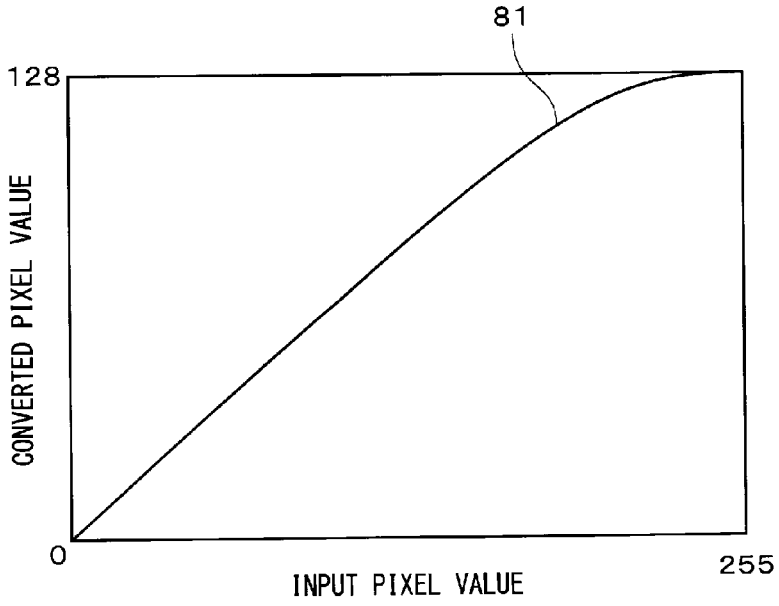
FIG. 8 is a graph showing a conversion curve.

FIG. 8 is a graph illustrating a conversion curve 81 indicating characteristics of the LUT corresponding to one head 214 regarding a type of recording medium 9. Hereinafter, discussion will be made with the reference sign 81 of the conversion curve given to the LUT. The horizontal axis represents input pixel values which are pixel values of the input image data 931, and the vertical axis represents converted pixel values which are pixel values of the converted image data. In the following discussion, though it is assumed that the input image data 931 is represented in a gradation range from 0 to 255, the input image data 931 is not limited to within the gradation range.

The conversion part 42 converts pixel values of pixels in a portion of the input image data 931 to be recorded by one head 214 into pixel values within a gradation range from 0 to 128 with reference to an LUT 81. As a matter of course, the gradation range after change is not limited to the range from 0 to 128. Pixel values of pixels in another portion of the input image data 931 to be recorded by another head 214 are also converted with reference to another corresponding LUT.

Figure 9:
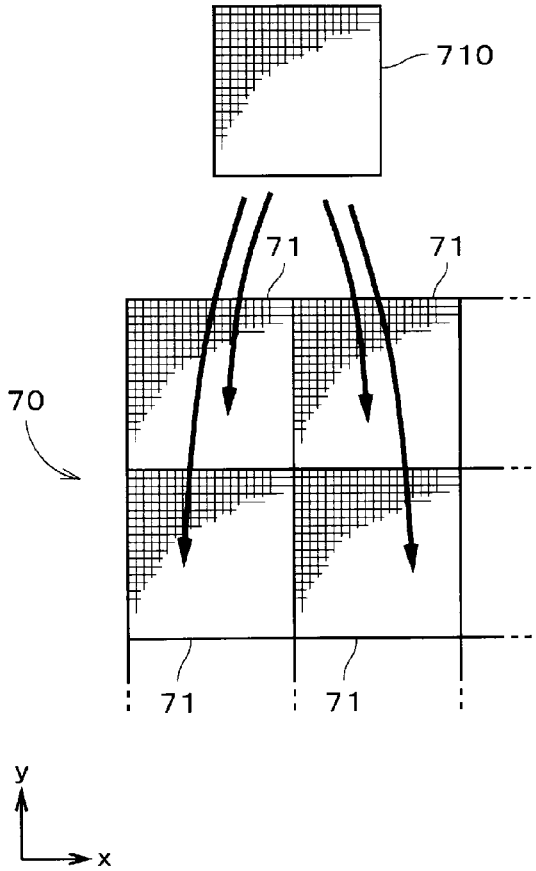
FIG. 9 is a view abstractly showing original image data and a threshold matrix.

When (part of) the converted image data is generated by the conversion part 42 (Step S11), the converted image data is transmitted to the comparator 44. FIG. 9 is a view abstractly showing converted image data 70 and a threshold matrix 710. In each of the converted image data 70 and the threshold matrix 710, a plurality of pixels or a plurality of elements are arranged in a row direction (indicated as the x direction in FIG. 9) corresponding to the X direction and in a column direction (indicated as the y direction in FIG. 9) perpendicular to the row direction. The comparator 44 compares the converted image data with the threshold matrix 710 for each color component, to thereby generate halftone dot image data (Step S12). In the image recording apparatus 1, a multitone image indicated by the converted image data is represented as a halftone dot image by the halftone dot image data.

When the converted image data 70 is halftoned (halftone dots thereof are formed) in Step S12, an entire area indicated by the converted image data 70 are divided into a lot of areas having the same size, to set repeat areas 71 each serving as a unit for halftoning. Each of the matrix storage parts 43 has a storage area which corresponds to one repeat area 71, and by setting a threshold value to each address (coordinates) of this storage area, the threshold matrix 710 is stored. Then, conceptually, by superimposing each repeat area 71 of the converted image data 70 and the threshold matrix 710 of each color component to each other and comparing the pixel value of the color component in each pixel of the repeat area 71 with the corresponding threshold value of the threshold matrix 710, it is determined whether or not to perform recording (forming a dot of the color) at a position of the pixel on the recording medium 9.

Actually, on the basis of an address signal from an address generator included in the comparator 44 of FIG. 3, one pixel value of the converted image data 70 is read out from the image memory 41 for each color component. On the other hand, an address signal indicating a position in the repeat area 71 corresponding to the pixel in the converted image data 70 is also generated by the address generator, and one threshold value in the threshold matrix 710 for each color component is specified and read out from the matrix storage part 43. Then, the comparator 44 compares the pixel value from the image memory 41 with the threshold value from the matrix storage part 43 for each color component, to thereby determine a value of the position (address) of the pixel in binary output image data for each color component. Therefore, with respect to one color component, in the converted image data 70 of multitone shown in FIG. 9, for example, a value of "1" is given (in other words, a dot is placed) to a position having a gradation value larger than the corresponding threshold value of the threshold matrix 710, and a value of "0" is given (in other words, no dot is placed) to the other pixels, and binary output image data is thereby generated as the halftone dot image data of the color component.

After (part of) the halftone dot image data for a portion (for example, a plurality of repeat areas 71 on the most (+y) side) in the converted image data to be recorded first is generated for each color, the moving control part 101 drives the moving mechanism 22 to start the relative movement of the recording medium 9 with respect to the heads 214 (Step S13). The ejection control part 102 controls the heads 214 to eject ink in accordance with the halftone dot image data. After the halftone dot image data is generated for another portion in the converted image data to be recorded next, in synchronization with the relative movement of the recording medium 9, the heads 214 further eject ink. Thus, while the above-discussed halftoning process (process of generating the halftone dot image data) is performed, the ejection of ink from the heads 214 is controlled concurrently with the relative movement of the recording medium 9.

After the heads 214 eject ink on the basis of the halftone dot image data for a portion in the converted image data to be recorded last, recording of color halftone dot image onto the recording medium 9 is completed (Step S14). After that, the recording medium 9 is collected by the collecting part 24 and the operation of moving the recording medium 9 is stopped (Step S15).

In the image recording apparatus 1, since the LUT indicating the relation between the input pixel values and the converted pixel values which are values, corresponding to the input pixel values, to be used for conversion of the signals to be inputted to the plurality of heads 214 is used, it is possible to prevent density unevenness in the image on the recording medium 9 between the heads 214. Hereinafter, the density of the image on the recording medium 9 will be referred to as "recording density". As discussed later, when any one head is changed, correction of the recording density of the image recorded by the changed head 214*a* is performed by updating the LUT for the changed head 214*a*.

Figure 10:
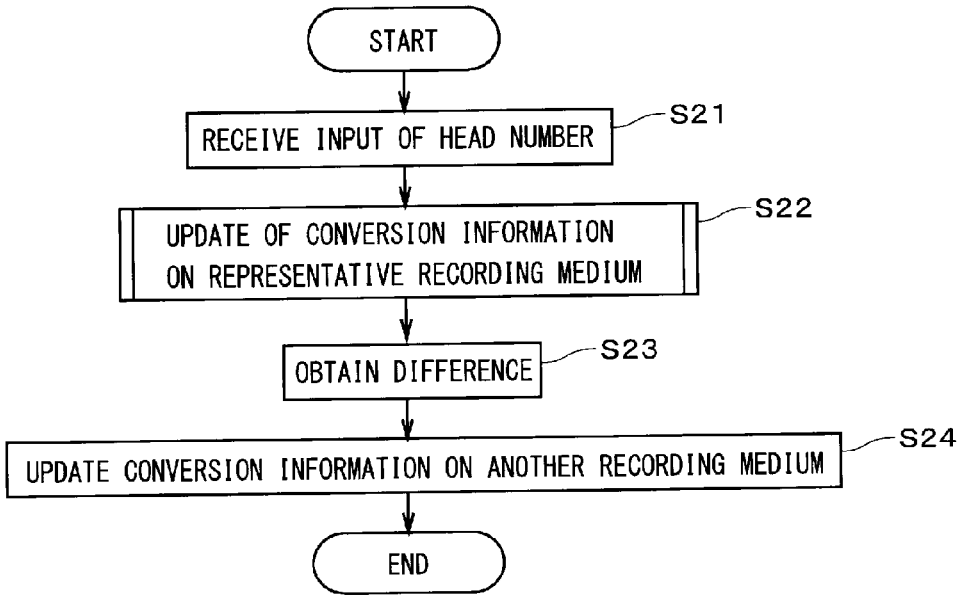
FIG. 10 is a flowchart showing an operation flow for updating conversion information.
Figure 11:
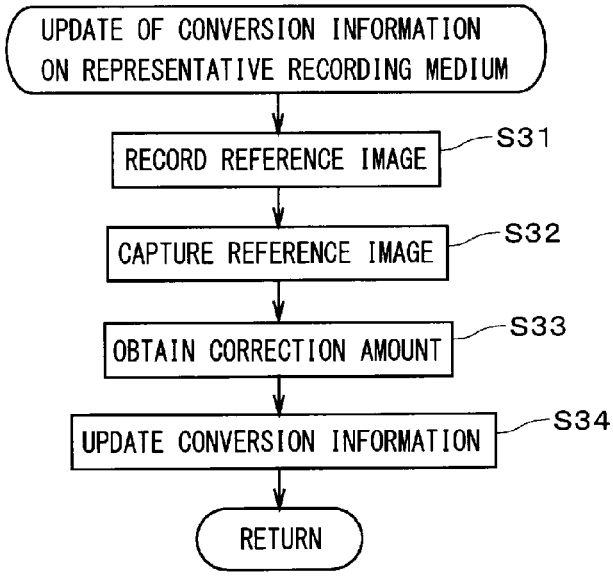
FIG. 11 is a flowchart showing an operation flow for updating the conversion information.

Next, discussion will be made, with reference to FIGS. 10 and 11, on an operation flow of updating the LUT corresponding to the changed head 214*a* after a defective head is changed. Hereinafter, though discussion will be made on a case where one head 214 for ejecting ink of K (black) is changed, the same operation flow of updating the LUT applies to another case where two or more heads 214 are changed. The same applies to still another case where some of a plurality of heads 214 for ejecting inks of other colors are changed. First, when the user changes the head 214, the changed head information is received by the changed head information receiving part 51 through a GUI or the like (Step S21).

Figure 12:
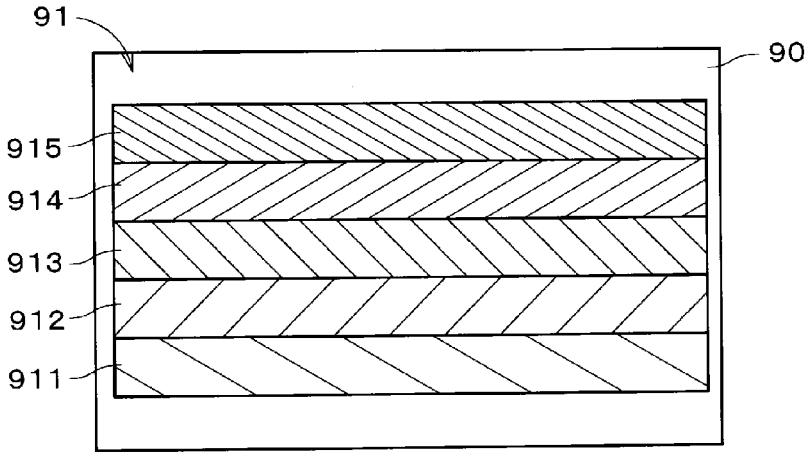
FIG. 12 is a view showing a reference image.

Next, one recording medium (hereinafter, referred to as a "representative recording medium 90") is selected out of a plurality of types of recording media, and the LUT on the representative recording medium 90 is updated (Step S22). Specifically, first, reference image data 932 is inputted from the external control part 11 shown in FIG. 3 to the machine body control part 10, and the machine body control part 10 controls the recording part 211 which has the changed head 214*a* to record a plurality of reference images 911 to 915 which are tint images having a plurality of densities onto the representative recording medium 90 as shown in FIG. 12 (FIG. 11: Step S31). In other words, the external control part 11 serves as a reference image recording control part for recording the reference images by using the heads 214, the moving mechanism 22, and the like through the machine body control part 10. Further, reference images having any numbers of densities other than 5 may be recorded onto the representative recording medium 90.

The plurality of reference images 911 to 915 are arranged in a vertical direction of FIG. 12, in other words, in the moving direction of the representative recording medium 90. Each of the reference images 911 to 915 is recorded in accordance with the input pixel values (see FIG. 8) which sequentially increase from the lower side of FIG. 12, in other words, while increasing the recording density. Hereinafter, the plurality of reference images 911 to 915 will be collectively referred to as "reference image 91". Further, the input pixel values corresponding to the reference images 911 to 915 will be represented as x1, x2, . . . , and x5, respectively.

Figure 13:
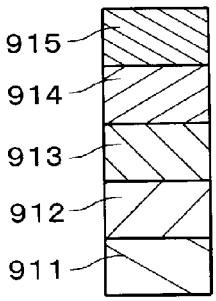
FIG. 13 is a view showing the reference image.

The reference image 91 is captured by the scanner 25 shown in FIG. 1 (Step S32). The LUT correction-amount acquisition part 52 shown in FIG. 6 performs a predetermined calculation for converting the color space from captured data of respective colors of RGB acquired by the scanner 25, to thereby generate monochrome image data of K (black) indicating the density. The monochrome image data may be acquired directly by the scanner 25. As shown in FIG. 13, an image of an area recorded by the changed head 214*a* is cut out from this monochrome image in accordance with the changed head information, and the recording density of each of the reference images 911 to 915 by the changed head 214*a* is thereby acquired. In FIG. 13, the portions corresponding to the recorded reference images 911 to 915 shown in FIG. 12 are represented by the same reference signs. Further, an image of an area recorded by a reference head 214 which is selected in advance out of the heads 214 other than the changed head 214*a* is also cut out, and the recording density of each of the reference images 911 to 915 by the reference head 214 is acquired.

Next, obtained is a correction amount $I_{base}(x)/I_1(x)$ which is a reciprocal of a ratio of the recording density $I_1(x)$ of the changed head 214*a* to the recording density $I_{base}(x)$ of the reference head 214 in the input pixel value x (x=x1, x2, . . . , and x5) (Step S33).

The correction amount $I_{base}(x)/I_1(x)$ determined in accordance with the reference images 911 to 915 is transmitted to the LUT updating part 53. The LUT updating part 53 acquires a converted pixel value $D_1(x)$ corresponding to the input pixel value x with reference to an LUT 82 before correction, assigned to the changed head number indicated by the thick solid line in FIG. 14. A converted pixel value $D_2(x)$ after correction corresponding to the input pixel value x can be obtained by using Eq. (1) on the basis of the correction amount $I_{base}(x)/I_1(x)$ and the converted pixel value $D_1(x)$.

$$D_2(x)=D_1(x)(I_{base}(x)/I_1(x)) \quad \text{(Eq. 1)}$$

Figure 14:
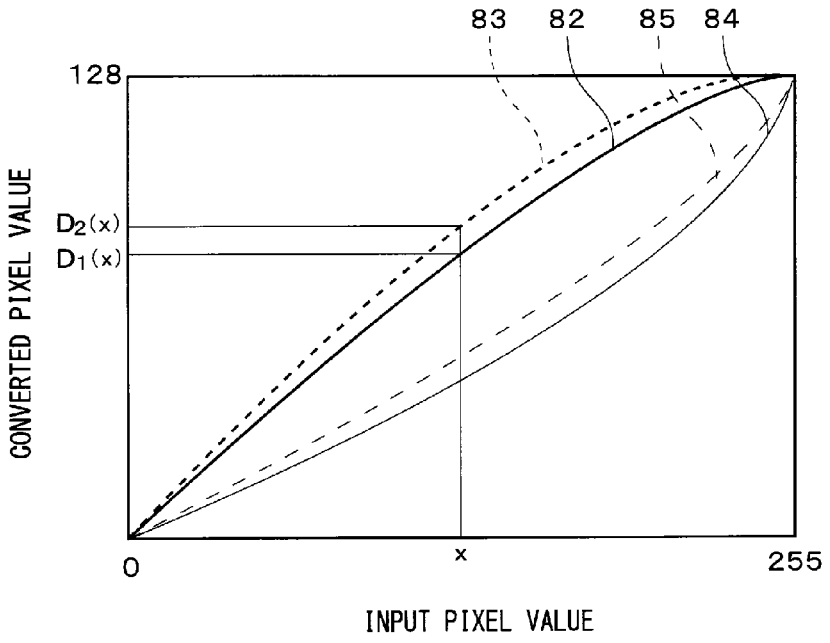
FIG. 14 is a graph showing a conversion curve.

Next, by interpolating intervals of the converted pixel values $D_2$(x1), $D_2$(x2), . . . , and $D_2$(x5) after correction corresponding to the input pixel values x1, x2, . . . , and x5 by the least-squares method, an LUT 83 indicated by the narrow-interval thick broken line in FIG. 14 is generated. The LUT 83 is inputted to the information storage part 103 and stored therein.

After the LUT on the representative recording medium 90 is updated (Step S34), obtained is difference data indicating signed difference of the converted pixel value corresponding to each input pixel value between the LUTs 82 and 83 (Step S23).

On the changed head 214*a*, conversion characteristics of the LUT to be associated with each type of recording medium can be regarded to be similar to the LUT associated with the head 214 before the change. Therefore, the LUT updating part 53 can obtain an LUT 85 on another recording medium after correction, which is indicated by the wide-interval broken line, by adding the above difference data to an LUT 84 on this another recording medium before correction, which is indicated by the thin solid line in FIG. 14. In other words, assuming that the converted pixel values obtained with respect to the input pixel value x (x is an integer of 0 to 255) of the input image data 931 with reference to the LUTs 82 to 84 are $LUT_{A1}[x]$, $LUT_{A2}[x]$, and $LUT_{B1}[x]$, the converted pixel value $LUT_{B2}[x]$ obtained with reference to the LUT 85 after correction is given by using Eq. (2).

$$LUT_{B2}[x]=LUT_{B1}[x]+(LUT_{A2}[x]-LUT_{A1}[x]) \quad \text{(Eq. 2)}$$

When the above process is performed on an LUT on each of all the recording media 9 other than the representative recording medium 90, the update of the LUTs on all types of recording media 9 regarding the changed head 214*a* is completed (Step S24). Further, since the surface property is significantly different for each type when the recording medium 9 is coated paper, the automatic update of the LUTs is especially suitable for the case where a plurality of types of coated paper are used as the recording medium 9.

Figure 15:
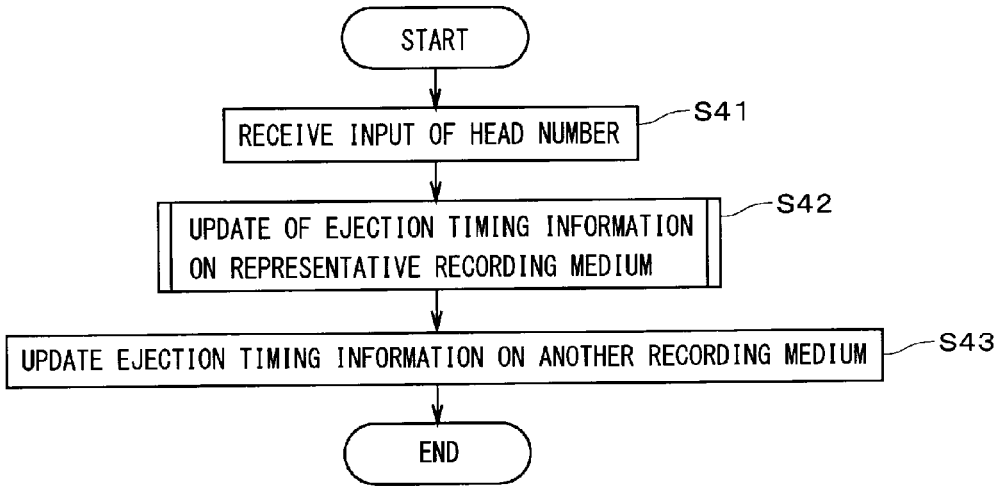
FIG. 15 is a flowchart showing an operation flow for updating ejection timing information.
Figure 16:
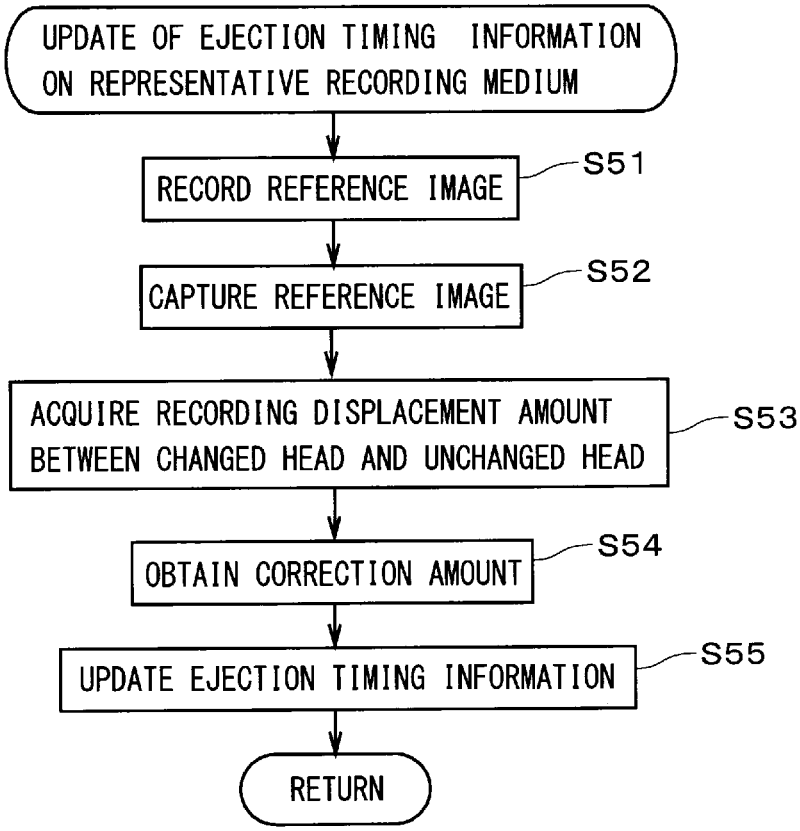
FIG. 16 is a flowchart showing an operation flow for updating the ejection timing information.

Next, discussion will be made on an operation flow of correcting the ejection timing information of the changed head 214*a* after the defective head 214 is changed, with reference to FIGS. 15 and 16. First, when the user changes any one of the heads 214, the changed head information is received by the changed head information receiving part 51 through a GUI or the like (Step S41). When Steps S21 to S24 have been already performed, however, Step S41 is omitted.

Figure 17:
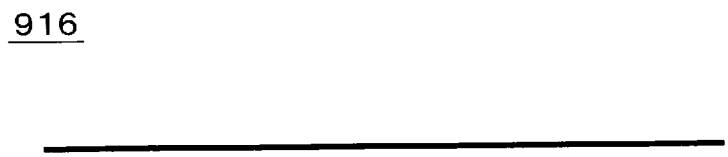
FIG. 17 is a view showing an input image.

Further, the representative recording medium 90 is selected and update of the ejection timing information on the representative recording medium 90 is performed (Step S42). Specifically, first, reference image data 932 (image data different from that in Step S31, however) is inputted from the external control part 11 to the image memory 41. The reference image data 932 represents an image 916 of line extending in a horizontal direction of FIG. 17 which corresponds to the arrangement direction of the heads 214. Then, under the control of the machine body control part 10, a reference image is recorded onto the representative recording medium 90 by using the changed head 214*a* and a plurality of other unchanged heads 214 (Step S51). In other words, the external control part 11 serves as a reference image recording control part for recording the reference image by using the heads 214, the moving mechanism 22, and the like through the machine body control part 10.

Figure 18:
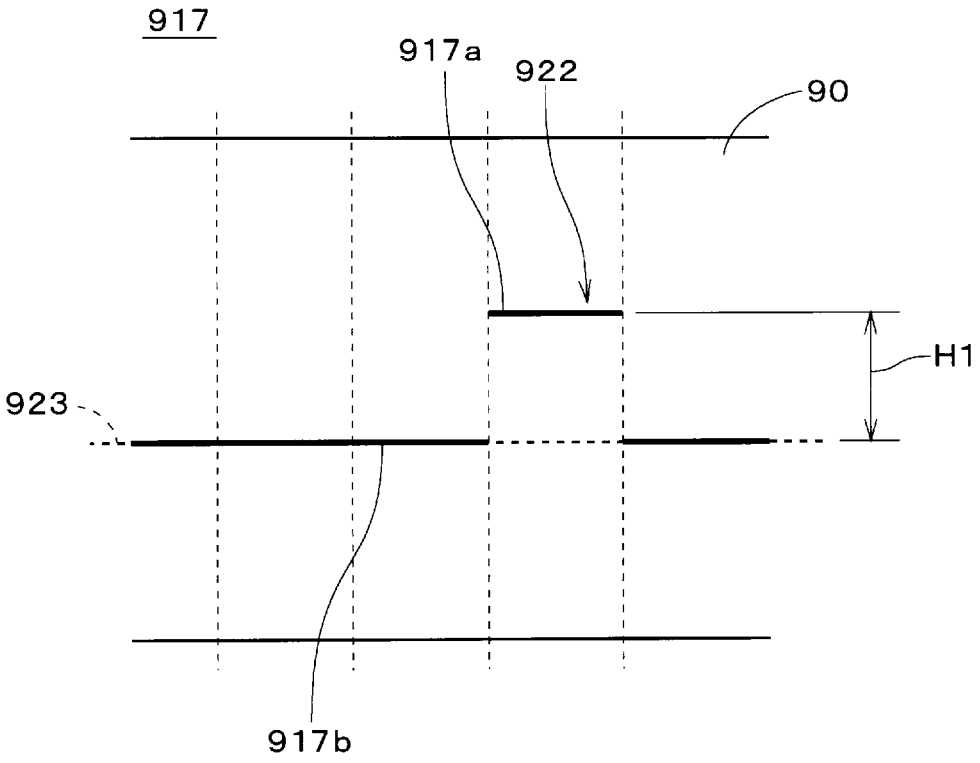
FIG. 18 is a view showing a reference image.

The reference image is captured by the scanner 25 shown in FIG. 1 (Step S52). The ejection timing correction-amount acquisition part 54 shown in FIG. 6 generates data of a monochrome image on the basis of captured data of respective colors of RGB acquired by the scanner 25. Hereinafter, since the monochrome image represents the recorded reference image, discussion will be made, regarding the monochrome image as the reference image. FIG. 18 is a view showing part of a reference image 917 indicated by the captured data. A direction from the lower side toward the upper side in FIG. 18 corresponds to the moving direction of the representative recording medium 90. In FIG. 18, boundaries of respective parts of the reference image 917, which are recorded by the heads 214 are indicated by the thin broken lines.

A portion of the reference image 917, which is represented by the reference sign 917*a*, is recorded by the changed head 214*a*. The other portion 917*b* of the reference image 917 is recorded by the heads 214 which are unchanged (hereinafter, referred to as "unchanged heads 214"). Hereinafter, a position of the portion 917*a* recorded by the changed head 214*a* in the moving direction is referred to as a "changed head recording position 922". A position of the portion 917*b* recorded by the unchanged heads 214 in the moving direction, which is indicated by the thick broken line, is referred to as an "unchanged head recording position 923". It can be seen that the changed head recording position 922 is positioned upper in FIG. 18 than the unchanged head recording position 923 and a landing timing of ink from the changed head 214*a* is earlier than that from the unchanged heads 214.

Next, the ejection timing correction-amount acquisition part 54 obtains a recording displacement amount H1 which is a distance between the changed head recording position 922 and the unchanged head recording position 923 in the moving direction (Step S53). A movement speed of the representative recording medium 90 by the moving mechanism 22 is inputted to the ejection timing correction-amount acquisition part 54 in advance, and by dividing the recording displacement amount H1 by the movement speed, the time difference between the unchanged head recording position 923 and the changed head recording position 922 is obtained as the correction amount (Step S54).

The correction amount determined in accordance with the reference image 917 is transmitted to the ejection timing updating part 55 shown in FIG. 6. Then, the ejection timing information of the changed head 214*a* is updated on the basis of the correction amount (Step S55). The changed head 214*a* thereby records an image onto the unchanged head recording position 923.

The ejection timing updating part 55 obtains a signed difference between the ejection timing information before correction and the ejection timing information after correction of the changed head 214*a* regarding the representative recording medium 90. By adding the above difference to the ejection timing information before correction of the changed head 214*a* regarding another recording medium, the ejection timing information of the changed head 214*a* regarding another recording medium is updated (Step S43).

Thus, discussion has been made on the constitution and the operation of the image recording apparatus 1, and the operation flow of correcting the recording densities and the operation flow of correcting the ejection timing information, and in the correction of the recording densities, the LUT updating part 53 updates the LUTs for the changed head 214*a* regarding the representative recording medium 90 and other types of recording media on the basis of the correction amounts and the changed head information which are determined in accordance with the reference images 911 to 915 on the representative recording medium 90. It is thereby possible to simplify the correcting operation of the recording densities of the changed head 214*a* as compared with a case where the correction amount is acquired and the LUT is updated every time when image recording onto a new type of recording medium is needed. As a result, it is possible to reduce a downtime of a recording operation of an image.

Further, in the correction of the ejection timing information, the ejection timing information on the representative recording medium 90 and other types of recording media regarding the changed head 214*a* is updated on the basis of the correction amount and the changed head information of the changed head 214*a* determined in accordance with the reference image 917 on the representative recording medium 90. It is thereby possible to simplify the correcting operation as compared with a case where the correction amount is acquired and the ejection timing information is updated every time when image recording onto a new type of recording medium is needed.

In the correction of the recording densities, since the correction amounts are automatically acquired by the scanner 25 and the LUT correction-amount acquisition part 52, it is possible to further simplify the correcting operation as compared with a case where the user sets the correction amounts. Similarly, in the correction of the ejection timing information, by using the scanner 25 and the ejection timing correction-amount acquisition part 54, it is possible to further simplify the correcting operation.

In the image recording apparatus 1, as the conversion information indicating the relation between the input pixel values and the converted pixel values, a cubic function where the input pixel value is a variable may be used. The information storage part 103 stores coefficients of terms in the cubic function.

An operation flow of updating the cubic function corresponding to the changed head 214*a* is almost the same as the above operation flow of updating the LUT. For updating the cubic function on the representative recording medium 90 regarding the changed head 214*a* (Step S22), the recording densities of the reference head 214 and the changed head 214*a* are acquired from the captured data and the correction amount which is a reciprocal of a ratio of the recording density of the changed head 214*a* to the recording density of the reference head 214 is obtained (Step S33). The converted pixel value with respect to the input pixel value of each reference image is obtained with reference to the cubic function before correction, and by multiplying the converted pixel value by the correction amount, the converted pixel value after correction is acquired. Then, the cubic function after correction is obtained by the least-squares method on the basis of the input pixel value and the converted pixel value after correction (Step S34).

For updating the cubic function on another recording medium regarding the changed head 214*a*, the difference between the cubic function before correction and that after correction on the representative recording medium 90 is obtained (Step S23). Assuming that the cubic function before correction on the representative recording medium 90 is $F_{A1}(x)$, the cubic function after correction is $F_{A2}(x)$, and the cubic function before correction on another recording medium is $F_{B1}(x)$, the function after correction $F_{B2}(x)$ is obtained by using Eq. (3) (Step S24).

$$F_{B2}(x)=F_{B1}(x)+(F_{A2}(x)-F_{A1}(x)) \quad \text{(Eq. 3)}$$

In the image recording apparatus 1, by using the cubic function as the conversion information between the input pixel values and the converted pixel values, it is possible to reduce the storage capacity in the information storage part 103. Further, any function other than the cubic function may be used.

Though the preferred embodiment of the present invention has been discussed above, the present invention is not limited to the above-discussed preferred embodiment, but allows various variations.

In the above-discussed preferred embodiment, instead of the LUT, conversion information indicating a relation between the input pixel values and values for correcting the intensity of signals to be inputted to each head 214 may be used. Also in this case, by performing the process in conformance with the above-discussed preferred embodiment, this conversion information corresponding to the changed head 214*a* is updated when any one head is changed. Thus, in the image recording apparatus 1, various conversion information indicating relations between the input pixel values and various values used for generation of signals to be inputted to the plurality of heads 214 corresponding to the input pixel values may be used.

Though the signed difference between the converted pixel value before correction and the converted pixel value after correction on the representative recording medium 90 is simply used for correction of the converted pixel value on another type of recording medium 9 in Eq. 2 and Eq. 3 in the discussion of the above-discussed preferred embodiment, the conversion information on another type of recording medium 9 may be corrected by various methods. For example, by multiplying the converted pixel value before correction on another type of recording medium 9 by a ratio between the converted pixel value before correction and the converted pixel value after correction on the representative recording medium 90, the converted pixel value after correction may be obtained.

In the image recording apparatus 1, dots of a plurality of sizes as a minimum unit may be formable by ejecting droplets of different amount from each head 214.

In the correcting operation of the recording densities and the correcting operation of the ejection timing information, the correction amounts may be determined by the user with reference to the reference image. In this case, since there is a possibility that appropriate correction amounts cannot be obtained by one processing, recording of the reference images and determination of the correction amounts are repeated as necessary while changing the input pixel values corresponding to a plurality of reference images. In the image recording apparatus 1, the recording density of the reference image to be recorded by the reference head 214 may be acquired in advance. In this case, after changing the head, even by recording the reference image only by the changed head 214*a*, the LUT 61 for the changed head 214*a* can be updated.

Though the external control part 11 substantially serves as the reference image recording control part for causing the head 214 and the like to record the reference image onto the representative recording medium 90 since the external control part 11 inputs the reference image data 932 to the machine body control part 10 in the above-discussed preferred embodiment, for example, the reference image recording control part may be implemented as a dedicated electric circuit in the machine body control part 10 or by using the external control part 11 and part of the machine body control part 10.

In the correction of the ejection timing information, it is not always necessary to record the reference images by using all the heads 214 in the recording part 211 including the changed head 214*a*, and the reference images may be recorded by two or more heads 214 including at least one changed head 214*a* and an unchanged head 214 for reference.

The plurality of heads 214 may be arranged in a plane parallel to the recording surface of the recording medium 9 in a direction crossing a direction perpendicular to the width direction of the recording medium 9. The moving mechanism 22 is not necessarily a mechanism for moving the recording media 9 but may be a mechanism in which for example, the recording part 211 is moved, to thereby relatively move the recording media 9 with respect to the recording part 211. The recording medium 9 may be a sheet-like base member having liquid repellency, such as a film or the like, or a plate-like member or the like formed of plastic. Further, recording may be performed onto so-called web which is continuous form paper.

The configurations of the above-described preferred embodiment and variations may be appropriately combined as long as there are no mutual inconsistencies.

While the invention has been shown and described in detail, the foregoing description is in all aspects illustrative and not restrictive. It is therefore understood that numerous modifications and variations can be devised without departing from the scope of the invention.

REFERENCE SIGNS LIST

1 Image recording apparatus
3 Control part
9, 9*a*, 9*b* Recording medium
10 Machine body control part
11 External control part (Reference image recording control part)
22 Moving mechanism
25 Scanner
42 Conversion part
51 Changed head information receiving part
52 LUT correction-amount acquisition part
53 LUT updating part
54 Ejection timing correction-amount acquisition part
55 Ejection timing updating part
61, 81 to 85 LUT
62 Ejection timing information
90 Representative recording medium
103 Information storage part
214 Head
214*a* Changed head
911 to 915, 917 Reference image
H1 Recording displacement amount
S11 to S15, S21 to S24, S31 to S34, S41 to S43, S51 to S55 Step

The invention claimed is:

1. An image recording apparatus for recording an image onto a recording medium, comprising:

a plurality of heads arranged in a width direction of a recording medium or arranged in a direction crossing a direction perpendicular to said width direction, for ejecting droplets of ink;

a moving mechanism for moving said recording medium relatively with respect to said plurality of heads in said direction perpendicular to said width direction; and a control part for controlling said plurality of heads and said moving mechanism to record an image onto said recording medium by one relative movement of said recording medium with respect to said plurality of heads, wherein each of said plurality of heads is individually changeable to a new head, and said control part comprises:

a storage part for storing a plurality of pieces of conversion information corresponding to a plurality of types of recording media and said plurality of heads, respectively, each piece of conversion information corresponding to one type of recording media and one head, each piece of conversion information indicating a relation between input pixel values indicated by input image data and values used for generation of signals to be inputted to a corresponding head;

a conversion part for converting pixel values of input image data by using pieces of conversion information associated with said plurality of heads and one type of recording medium out of said plurality of types of recording media;

a reference image recording control part for recording a plurality of reference images corresponding to a plurality of input pixel values, respectively, onto a representative recording medium by at least one changed head out of said plurality of heads;

a changed head information receiving part for receiving changed head information indicating said changed head among said plurality of heads; and a conversion information updating part to which correction amounts on pieces of conversion information corresponding to said changed head are inputted, said correction amounts being determined in accordance with said plurality of reference images which are recorded, said conversion information updating part updating said pieces of conversion information on said representative recording medium and another type of recording medium on the basis of said changed head information and said correction amounts.

2. The image recording apparatus according to claim 1, further comprising:

a scanner for capturing said plurality of reference images which are recorded, to acquire captured data, wherein said control part further comprises:

a correction-amount acquisition part for acquiring a plurality of recording densities from said captured data in accordance with said changed head information, said plurality of recording densities corresponding to said plurality of input pixel values regarding said changed head, obtaining said correction amounts of said pieces of conversion information corresponding to said changed head on the basis of said plurality of recording densities, and inputting said correction amounts to said conversion information updating part.

3. The image recording apparatus according to claim 1, wherein each of said plurality of pieces of conversion information is a look-up table.

4. The image recording apparatus according to claim 1, wherein each of said plurality of pieces of conversion information is a function where input pixel value is a variable.

5. The image recording apparatus according to claim 1, wherein said conversion information updating part obtains a difference between a piece of conversion information before updating and that after updating corresponding to said changed head on said representative recording medium, and adds said difference to a piece of conversion information corresponding to said changed head on said another recording medium to update it.

6. An image recording apparatus for recording an image onto a recording medium, comprising:

a plurality of heads arranged in a width direction of a recording medium or arranged in a direction crossing a direction perpendicular to said width direction, for ejecting droplets of ink;

a moving mechanism for moving said recording medium relatively with respect to said plurality of heads in said direction perpendicular to said width direction; and a control part for controlling said plurality of heads and said moving mechanism to record an image onto said recording medium by one relative movement of said recording medium with respect to said plurality of heads, wherein each of said plurality of heads is individually changeable to a new head, and said control part comprises:

a storage part for storing a plurality of pieces of ejection timing information corresponding to a plurality of types of recording media and said plurality of heads, respectively, each piece of ejection timing information corresponding to one type of recording medium and one head, each piece of ejection timing information indicating an ejection timing of a corresponding head;

a reference image recording control part for recording a reference image onto a representative recording medium by two or more heads including at least one changed head and an unchanged head out of said plurality of heads;

a changed head information receiving part for receiving changed head information indicating said changed head among said plurality of heads; and an information updating part to which a correction amount on pieces of ejection timing information corresponding to said changed head is inputted, said correction amount being determined in accordance with said reference image which is recorded, said information updating part updating said pieces of ejection timing information on said representative recording medium and another type of recording medium on the basis of said changed head information and said correction amount.

7. The image recording apparatus according to claim 6, further comprising:

a scanner for capturing said reference image which is recorded, to acquire captured data, wherein said control part further comprises:

a correction-amount acquisition part for acquiring a recording displacement amount between said two or more heads from said captured data in accordance with said changed head information, obtaining said correction amount of said pieces of ejection timing information corresponding to said changed head on the basis of said recording displacement amount, and inputting said correction amount to said information updating part.

8. The image recording apparatus according to claim 6, wherein said information updating part obtains a difference between a piece of ejection timing information before updating and that after updating corresponding to said changed head on said representative recording medium, and adds said difference to a piece of ejection timing information corresponding to said changed head on said another recording medium to update it.

9. A recording density correction method of correcting recording densities by a changed head in an image recording apparatus which comprises:

a plurality of heads arranged in a width direction of a recording medium or arranged in a direction crossing a direction perpendicular to said width direction, for ejecting droplets of ink;

a moving mechanism for moving said recording medium relatively with respect to said plurality of heads in said direction perpendicular to said width direction; and a control part for controlling said plurality of heads and said moving mechanism to record an image onto said recording medium by one relative movement of said recording medium with respect to said plurality of heads, said control part comprising a storage part for storing a plurality of pieces of conversion information corresponding to a plurality of types of recording media and said plurality of heads, respectively, each piece of conversion information corresponding to one type of recording medium and one head, each piece of conversion information indicating a relation between input pixel values indicated by input image data and values used for generation of signals to be inputted to a corresponding head, and each of said plurality of heads being individually changeable to a new head, said recording density correction method comprising:

a) recording a plurality of reference images corresponding to a plurality of input pixel values, respectively, onto a representative recording medium by at least one changed head out of said plurality of heads;

b) determining correction amounts of pieces of conversion information corresponding to said changed head in accordance with said plurality of reference images which are recorded; and c) updating said pieces of conversion information on said representative recording medium and another type of recording medium on the basis of said correction amounts.

10. The recording density correction method according to claim 9, wherein said image recording apparatus further comprises:

a scanner for capturing said plurality of reference images which are recorded, to acquire captured data, and said step b) comprises:

acquiring a plurality of recording densities from said captured data in accordance with said changed head information, said plurality of recording densities corresponding to said plurality of input pixel values regarding said changed head; and obtaining said correction amounts of said pieces of conversion information corresponding to said changed head on the basis of said plurality of recording densities.

11. The recording density correction method according to claim 9, wherein each of said plurality of pieces of conversion information is a look-up table.

12. The recording density correction method according to claim 9, wherein each of said plurality of pieces of conversion information is a function where input pixel value is a variable.

13. The recording density correction method according to claim 9, wherein said step c) comprises obtaining a difference between a piece of conversion information before updating and that after updating corresponding to said changed head on said representative recording medium; and adding said difference to a piece of conversion information corresponding to said changed head on said another recording medium to update it.

14. An ejection timing correction method of correcting an ejection timing on a changed head in an image recording apparatus which comprises:

a plurality of heads arranged in a width direction of a recording medium or arranged in a direction crossing a direction perpendicular to said width direction, for ejecting droplets of ink;

a moving mechanism for moving said recording medium relatively with respect to said plurality of heads in said direction perpendicular to said width direction; and a control part for controlling said plurality of heads and said moving mechanism to record an image onto said recording medium by one relative movement of said recording medium with respect to said plurality of heads, said control part comprising a storage part for storing a plurality of pieces of ejection timing information corresponding to a plurality of types of recording media and said plurality of heads, respectively, each piece of ejection timing information corresponding to one type of recording medium and one head, each piece of ejection timing information indicating an ejection timing of a corresponding head, and each of said plurality of heads being individually changeable to a new head, said ejection timing correction method comprising:

a) recording a reference image onto a representative recording medium by two or more heads including at least one changed head and an unchanged head out of said plurality of heads;

b) determining a correction amount of pieces of ejection timing information corresponding to said changed head in accordance with said reference image which is recorded; and c) updating said pieces of ejection timing information on said representative recording medium and another type of recording medium on the basis of said correction amount.

15. The ejection timing correction method according to claim 14, wherein said image recording apparatus further comprises a scanner for capturing said reference image which is recorded, to acquire captured data, said step b) comprises:

acquiring a recording displacement amount between said two or more heads from said captured data in accordance with said changed head information; and obtaining said correction amount of said pieces of ejection timing information corresponding to said changed head on the basis of said recording displacement amount.

16. The ejection timing correction method according to claim 14, wherein said step c) comprises:

obtaining a difference between a piece of ejection timing information before updating and that after updating corresponding to said changed head on said representative recording medium; and adding said difference to a piece of ejection timing information corresponding to said changed head on said another recording medium to update it.

* * * * *